US005478252A

United States Patent [19]

Lecomte et al.

[11] Patent Number: 5,478,252

[45] Date of Patent: Dec. 26, 1995

[54] DISCONNECTABLE MALE CONNECTOR FOR COMMUNICATIONS NETWORKS

[75] Inventors: Didier Lecomte, Cavaillon; Laurent Laloum, Avignon, both of France

[73] Assignee: Societe Anonyme Dite: Alcatel Cable Interface, Vrigne aux Bois, France

[21] Appl. No.: 307,691

[22] PCT Filed: Feb. 10, 1994

[86] PCT No.: PCT/FR94/00154

§ 371 Date: Sep. 23, 1994

§ 102(e) Date: Sep. 23, 1994

[87] PCT Pub. No.: WO94/18724

PCT Pub. Date: Aug. 18, 1994

[30] Foreign Application Priority Data

Feb. 10, 1993 [FR] France ..... 93 01463

[51] Int. Cl.[6] ..... H01R 13/62

[52] U.S. Cl. ..... 439/180; 439/154

[58] Field of Search ..... 439/676, 76, 395, 439/397, 404–405, 344, 418, 425, 620, 469, 460, 180, 211, 65, 55, 71–72, 92, 93, 64–68

[56] References Cited

U.S. PATENT DOCUMENTS

| | | | |
|---|---|---|---|
| 4,286,835 | 9/1981 | Adams et al. | 439/395 |
| 4,412,715 | 11/1983 | Bogese, II | 439/425 |
| 4,448,474 | 5/1984 | Melnychenko | 439/337 |
| 4,636,023 | 1/1987 | Olsson | 439/449 |
| 4,707,046 | 11/1987 | Strand | 439/314 |
| 4,820,192 | 4/1989 | Denkmann et al. | 439/404 |
| 4,863,397 | 9/1989 | Hatch, Jr. | 439/475 |
| 4,932,882 | 6/1990 | Kang | 439/22 |
| 4,969,836 | 11/1990 | Magnier et al. | 439/188 |
| 5,090,916 | 2/1992 | Magnier | 439/352 |
| 5,118,310 | 6/1992 | Stroede et al. | 439/676 |
| 5,181,858 | 1/1993 | Matz et al. | 439/188 |

FOREIGN PATENT DOCUMENTS

| | | | |
|---|---|---|---|
| 0175868A3 | 4/1986 | European Pat. Off. . | |
| 0419766 | 4/1991 | European Pat. Off. | 439/676 |
| 2379918 | 9/1978 | France . | |
| 3918518A1 | 12/1990 | Germany . | |
| 2243033 | 10/1991 | United Kingdom . | |

*Primary Examiner*—David L. Pirlot
*Assistant Examiner*—Jill DeMello
*Attorney, Agent, or Firm*—Sughrue, Mion, Zinn, Macpeak & Seas

[57] ABSTRACT

The invention concerns a disconnectable male connector for a communications network including connecting means between wires (43) corresponding to the lines of a communications cable (44) and the terminals of a female connector which are connected to the lines of the communications network when the male connector is inserted in the female connector and means (41) for locking the male connector to the female connector, wherein said connection means (46, 81, 100) and said locking means (41, 80) can separate if the cable (44) is pulled. Applications include the integrated services digital network.

20 Claims, 4 Drawing Sheets

DISCONNECTABLE MALE CONNECTOR FOR COMMUNICATIONS NETWORKS

TECHNICAL FIELD

The present invention concerns a disconnectable male connector for communications networks.

It applies in particular to transmission networks using multiline cables such as local area networks and other computer data or digital telephone data transmission networks. It is essential to have a simple way to connect one or more computer and/or telephone data processing terminals in parallel or series with each such network, depending on the type of network concerned.

DESCRIPTION OF THE PRIOR ART

European patent application No 0 366 556 filed 26 Oct. 1989 (corresponding to U.S. Pat. No. 4,969,836) describes a male connector for connecting a computer and/or telephone terminal to a network via the lines of a communications cable by inserting the male connector into a female connector having connecting terminals connected to the network.

That patent application describes a universal connection system for connecting a processor terminal to a data transmission network. That universal system includes a male connector and a female connector. The male connector includes a parallelepiped-shape insulative support having two sides, a top, a bottom, a front and a back, and connecting terminals partly embedded in the support and projecting from its top or bottom. Those terminals are connected to lines of a communications cable surrounded by an insulative jacket and entering the support from behind. The connecting terminals of the male connector enter into sliding contact with respective terminals of a female connector. Those terminals of the female connector are in a casing and connected to respective lines of a communications network. Contact is established between the terminals of the male and female connectors when the male connector is inserted into an opening in the front of the female connector. That opening has edges parallel to respective sides of the insulative support of the male connector. The insulative support described in the above-mentioned patent application also has a rigid elastic tongue for locking the male connector in position.

An essential advantage of that type of male connector is its very compact size and the fact that the male connector is effectively locked in position in the female connector.

Those male connectors are of unitary construction, however, or effectively of unitary construction; this means that in normal use the male connector part is undeformable. Human intervention is essential to separate the male and female connectors. The male connector therefore remains connected to the female connector if the cable is pulled, with all the attendant and potentially very serious consequences: the risk that people can trip over the cable, fall and hurt themselves, pulling over an expensive piece of equipment such as a computer or a measuring instrument.

French patent application No 90 08831 filed 11 Jul. 1990 (corresponding to U.S. Pat. No. 5,090,916) describes a male connector for computer and/or telephone communications networks of the kind described above having a bolt-like member engaging under the rigid elastic tongue and connected to the cable to release the tongue if the cable is pulled with the male connector inserted into the female connector. With that connector, disconnection is made easier if the cable connecting the male connector to a piece of equipment is pulled accidentally with the male connector inserted into the female connector, but the design of the connector is relatively complicated.

Prior art male connectors make the electrical contact between a contact and a wire corresponding to a line of a communications cable by displacement of the contact and perforation of the insulation of the wire. Accordingly, they have various drawbacks:

- the position of the contact being precisely specified by various international standards, such as ISO standard 8877, for example, crimping requires a special tool and this position is not each to check on site, with the result that one cannot be certain that the position and orientation of the contacts conform to these standards.
- in all these connector types the contact is retained by barbs, a fixing method which cannot assure correct positioning of the contacts. Their active surfaces, the area in which the electrical connection is made, all have different orientations relative to the reference.
- a high force is applied to the contact to cause it to perforate the insulation, pass through the copper strands and be held in the plastics material of the connector. Consequently the various points of contact with the contacts and the corresponding wires of a cable are aligned on a curve rather than on a straight line. Also, the wires must be stranded wires. The mechanical force damages the contact surface.

SUMMARY OF THE INVENTION

An object of the invention is to solve the problems of disconnection, when the cable is pulled accidentally, by means of a solution that is simpler and less costly.

The invention concerns a disconnectable male connector for a communications network, including connection means between wires corresponding to the lines of a communications cable, and the terminals of a female connector which are connected to the lines of the communications network when said male connector is inserted in the female connector, and means for locking the male connector to the female connector, characterized in that said connection means and said locking means can separate if the cable is pulled.

The locking means advantageously include a connection head having at least one cavity. The connection means include a body having a peg which enters said cavity to enable relative positioning of these means. The connection head comprises two lateral tongues each having an inclined surface near its end. The body has two inclined sides on which the respective inclined surfaces of the two tongues bear when these two means are fastened together.

A connector of this kind has many advantages, including:

- it can reduce the number of components by increasing the functionality of each component,
- it allows rapid disconnection by separation into two parts,
- it can reduce the cost of manufacture.

Another object of the invention is to solve the other problems by separating the following functions: electrical contact with the terminals of the female connector, fixing to the insulative support, electrical contact with the wires of the cable, and especially by virtue of the use of a new way of making contact with the wires of the communications cable.

Thus, in one particularly advantageous embodiment of the connector of the invention the connection means include connecting means for connection to said wires of the communications cable and sliding contact means for contacting the respective terminals of the female connector.

The connecting means for connection to the wires of the communications cable are advantageously associated with immobilizing means for immobilizing the cable so that the wires cannot move.

The connector advantageously comprises a support containing the contact means and a cover comprising said connection means which fits over said support to make the connection between the contact means and the connection means by forcing one onto the other.

The contact means include respective forked contacts for each wire, each contact being beneath the end of a wire so that when the cover is forced onto said support each end of the wire is crimped into the fork of a contact. Each contact comprises at least two branches each having on its inside surface(s) at least one sharp projection adapted to tear the insulation of the respective wire to establish contact with the core thereof. The forked contacts are attached to the surface of a printed circuit including printed tracks for making contact with the respective terminals of the female connector.

The connector of the invention advantageously comprises a support having a cavity at the front in which can be placed the printed circuit whose front part then rests on inclined walls and whose rear part then rests on pegs, said cavity opening to the exterior via guide grooves for aligning the male connector correctly with a corresponding female connector.

The cover advantageously comprises connection means including a crimping member having a plurality of housings into which the ends of the wires of the communications cable are inserted. The cover has a rear part through which the end of the cable can be passed after the jacket is removed to expose the ends of the wires; this rear part being Joined to a front part having housings for receiving these wire ends by an inclined bearing surface. The rear part of the cover has two side walls with racks on the inside between which can be inserted a cable immobilizing member having racks on the outside adapted to mate with the racks on the inside of the cover. The immobilizing member also comprises a tab on each side adapted to move in a groove in each rack on the inside of the cover.

The cover has slots at the sides so that it can be fitted to the walls of the support and vertical grooves adapted to fit over respective vertical projections on the sides of said support.

An advantageous breakdown of the component parts of the connector of the invention based on two functions includes:

firstly the components which provide the mechanical immobilizing function, namely the cable immobilizing member and the cover which nests in the support to close the assembly: these components can be in metallized plastics material for continuity with the cable shield and the nth pin, for example the 9th pin of the female connector;

secondly the components which locate external parts: the connecting member locates the wires of the cable in the housings, the connection head locates the contacts of the female connector in line with each track of the printed circuit. These parts can be in transparent insulative plastics material to show the various connecting parts and the position of the wires in the connecting member or the position of the printed circuit in the connection head, which cannot be conductive without shorting the tracks together, in which case there would be a common electrical point, which is contrary to the requirement to obtain transmission on eight independent lines, for example.

A connector with these features has many advantages, including:

The position of each contact point is fixed before the wires are crimped by means requiring only very moderate forces.

The contacts are retained by means requiring no mechanical deformation of material, for example gluing, molding or soldering to a printed circuit.

It is no longer necessary to apply a high force to fit the contacts, with the result that the contact points are correctly located and aligned.

Offsetting the crimping of the wires towards the rear means that larger overall diameter wires can be used, i.e. cables of higher performance.

In one embodiment of the invention each forked contact is the first end of a connecting terminal partially embedded in the support and whose second end makes the contact with the respective terminals of the female connector.

DETAILED DESCRIPTION OF EMBODIMENTS

Figure 1:
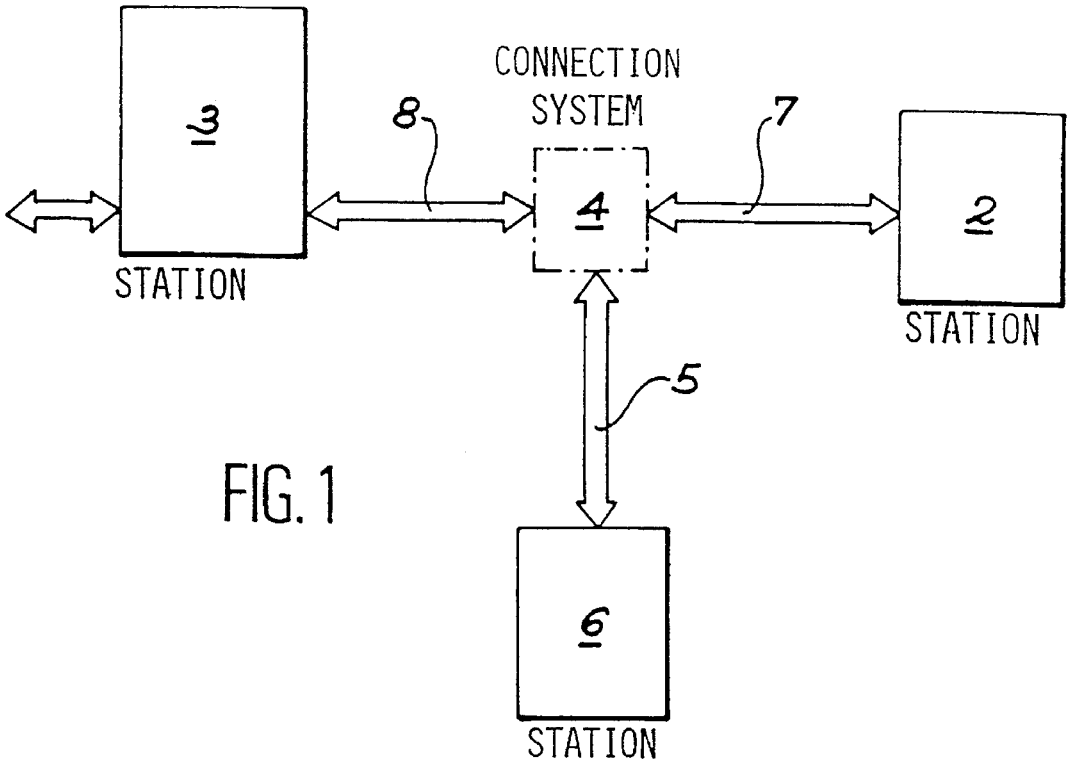
FIG. 1 is a diagram showing a data transmission network in which a connector in accordance with the invention is used.

FIG. 1 is a diagram showing a data transmission network linking two stations 2, 3 communicating by means of a multiline cable. The connection system 4 enables another terminal or station 6 to be connected to the network by a connecting cable 5. The connection system includes a female connector connected to two successive sections 7, 8 of the network's communications cable and the male connector of the invention connected to the connecting cable 5. Like the network transmission cable sections 7, 8, the connecting cable 5 is preferably a multiline cable with a grounded shield. For example, it can include eight conductive lines each comprising an insulated conductor. It can also include a grounded shield, for example a metal covering wrapped around the lines.

In this type of multiline cable some lines are used to transmit in one direction and others are used to transmit in the opposite direction.

Figure 2:
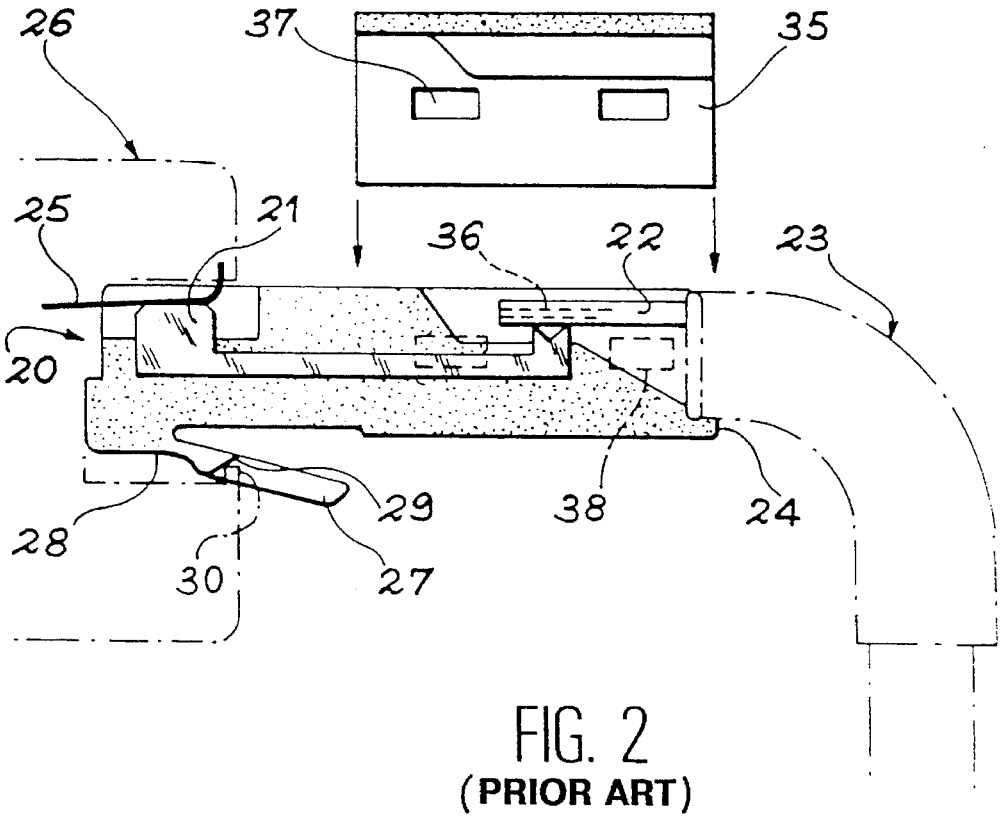
FIG. 2 (PRIOR ART)
FIG. 2 is a diagram showing in longitudinal section a prior art male connector inserted in a female connector.

A prior art computer and/or telephone communications network male connector is shown diagrammatically in longitudinal section in FIG. 2. This connector includes a parallelepiped-shape insulative support 20. Connecting terminals 21 are partially embedded in the support 20 and open onto its top surface. These terminals are connected to wires 22 forming the lines of a communications cable 23 with an insulative jacket and entering the support 20 through its rear surface 24.

The connecting terminals 21 of the male connector enter into sliding contact with respective terminals 25 of a female connector. The terminals of the female connector are enclosed in a casing 26 and connected to respective lines of the communications network. The casing of the female connector has an opening through which the male connector can be inserted.

The support 20 shown in FIG. 2 also includes a rigid elastic tongue 27 fastened to the support near its bottom and front sides by a base 28 wider than the tongue 27. The tongue 27 and the base 28 are inclined relative to the bottom surface of the support 20 and engage in a recess in the front of the casing 26. The base 28 includes a transverse locking shoulder 29. To facilitate insertion of the male connector in the female connector the base 28 and the shoulder 29 can be joined by an inclined surface. The shoulder 29 is itself preferably inclined, as shown in the figure.

During insertion of the male connector in the opening of the female connector the tongue 27 and the base 28 are progressively deflected towards the bottom surface of the support 20 because the base and the inclined surface bear and slide on the edges of the recess 30. On completion of insertion the tongue 27 and the base 28 are spaced away from the bottom surface of the support 20 and lock the male connector in position by virtue of the shoulder 29 bearing against an inside wall of the front of the casing 26.

The connector further includes a cover 35 which can be made from an insulative material, for example, and which surrounds the support 20 near its rear surface 24. This cover partly covers the sides and top of the support and bears on the end 36 of each wire 22 of the communications cable 23 inside the support 20; this makes the contacts between the ends of the wires and the respective terminals of the male connector. Each connecting terminal 21 has, at the rear surface 24 of the support 20, a pointed shape such that when the cover 35 bears on the line 22 it perforates the insulation around the wire as far as the conductor surrounded by this insulation; the terminal and the conductor of the wire are then in contact. The cover 35 can be secured to the support 20 by slots 37 on the sides of the cover, for example, fitting over bosses 38 on the sides of the support 20. The cover 35 effectively immobilizes the wires 22 of the cable 23.

The sides of the support 20 are at least partially metallized near the respective contacts between the connecting terminals 21 and the ends 36 of the wires of the cable to form a shield connected to a metal shield of the cable. This shield is adapted to contact a shield around the terminals of the female connector inside the casing 26. The shield of the female connector is connected to a network line shield.

A connector of this kind has many defects, however:

it is not disconnected if the cable is pulled accidentally, one cannot be certain that the position and orientation of the points of contact between the wires and the terminals conform to the standards, the method of fixing the contacts does not locate them correctly, the points of contact are not aligned.

To alleviate these various defects the connector of the invention separates the connection/locking functions from the following three functions: electrical contact with the terminals of the female connector, fixing to the insulative material support and electrical contact with the wires of the cable.

Figure 3:
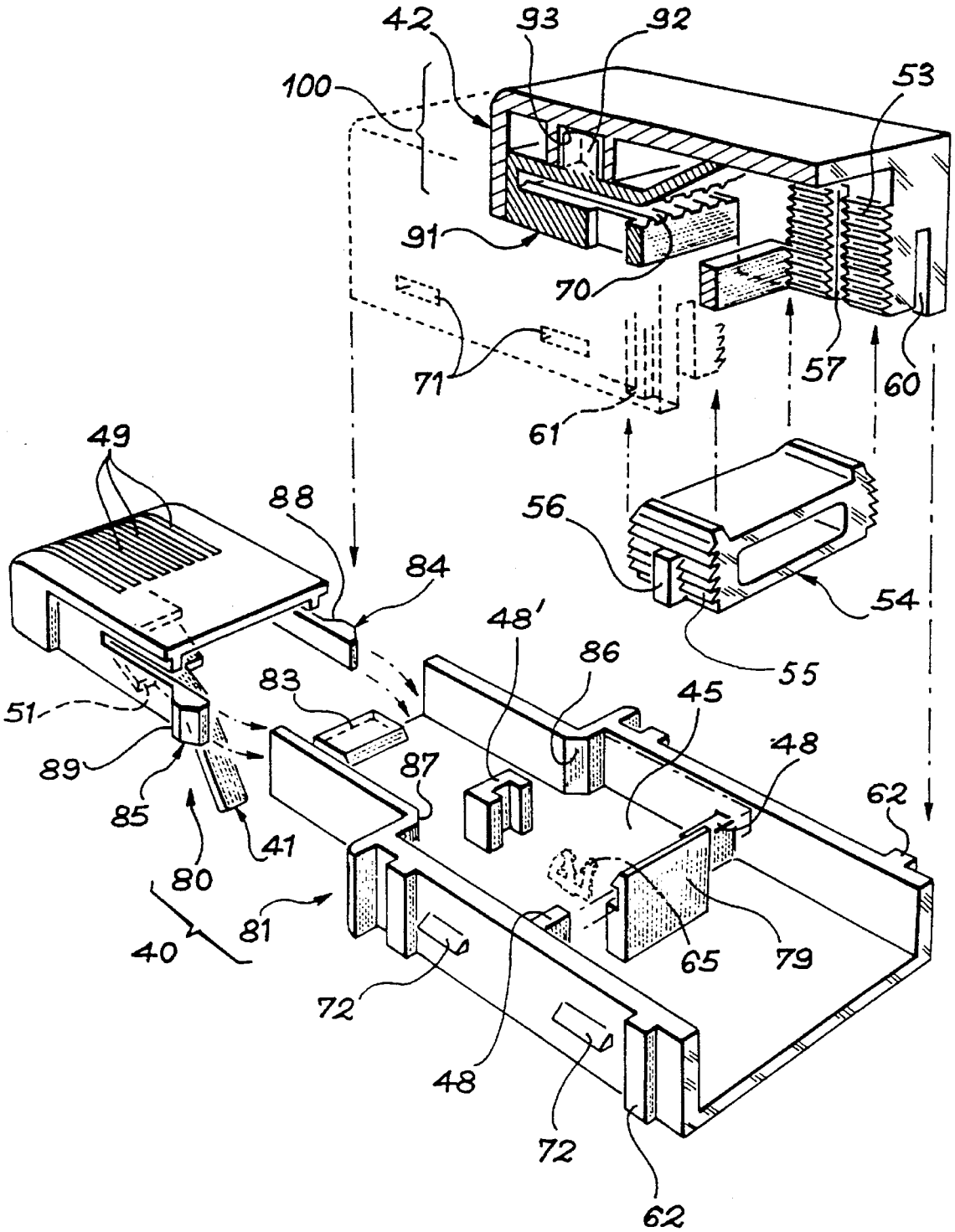
FIG. 3 is a diagrammatic exploded perspective view in partial section of the male connector of the invention.
Figure 4:
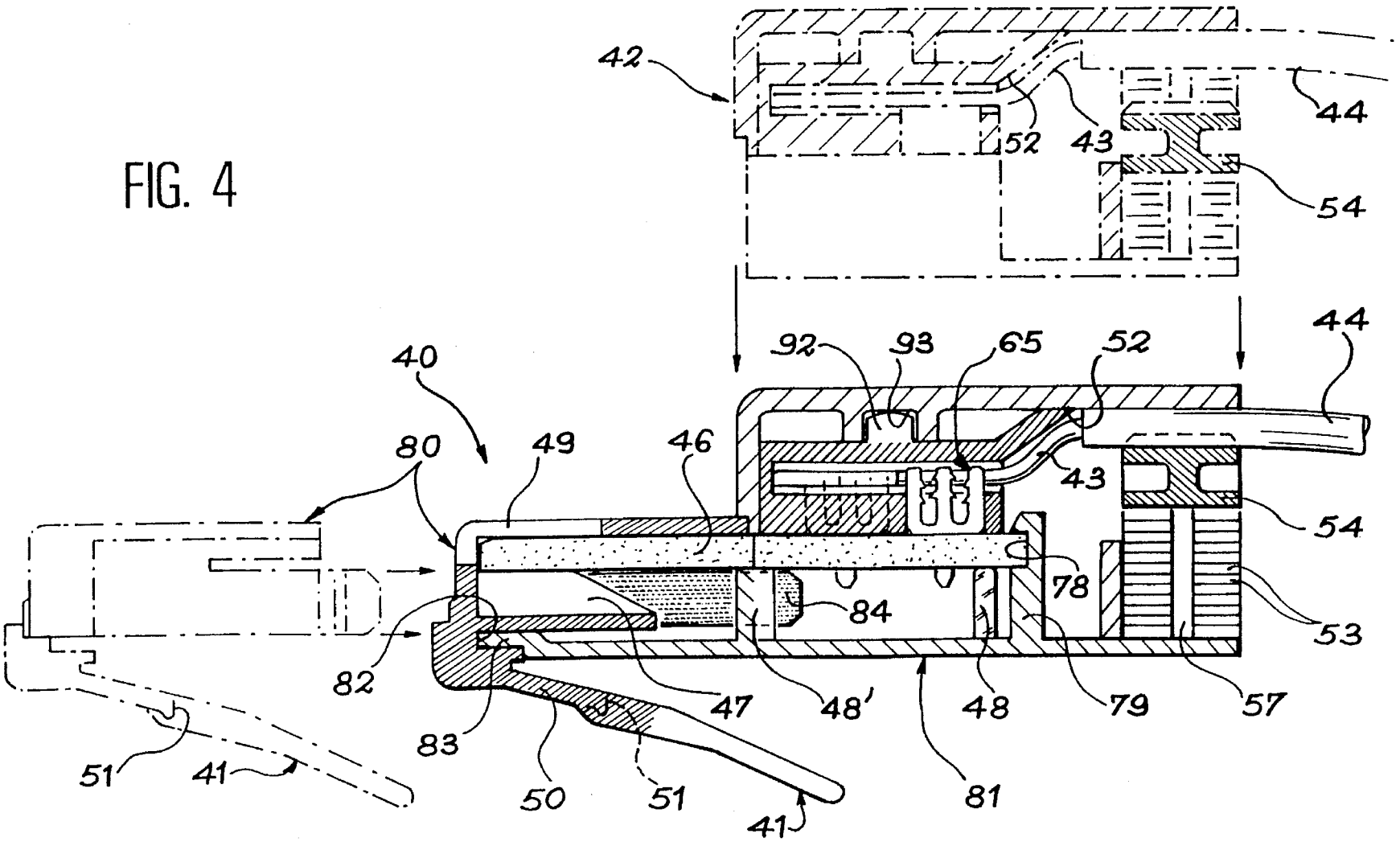
FIG. 4 is a longitudinal sectional view of the male connector of the invention showing two positions of the cover and two positions of the front part of the support.

Accordingly, as shown in FIGS. 3 and 4, the male connector of the invention is in two parts:

a support casing 40 comprising two separable parts, namely an insulative material front part 80 and a metallized rear part 81, the front part 80 having in its lower part a rigid elastic tongue 41, a cover assembly 100 comprising an insulative material connecting member 91 locating the wires 43 of the metallized part 54 immobilizing the communications cable 44 and a metallized cover 42.

The support casing 40 has in its rear part 81 a cavity 45 for receiving a printed circuit 46 whose front part rests on inclined walls 47 of the front part 80 and whose middle and rear parts rest on pegs 48 and 48' of the rear part 81. The rear part of the printed circuit 46 is inserted in the groove 78 of an abutment 79 fastened to the rear part. The cavity 45 in the front part 80 opens towards the exterior through guide grooves 49 which guide the contacts of the female connector accurately towards the respective contacts of the printed circuit 46.

The casing 40 is thus in two parts: a front part or connection head 80 and a rear part or body 81, which can be entirely metallized to protect the data transmitted against electromagnetic interference and electrostatic discharge.

The connection head 80 includes a cavity 82 receiving a peg 83 of the body 81. This peg locates the two parts relative to each other. The printed circuit 46 serves as a transverse guide between the two parts 80 and 81.

The part 80 is held onto the part 81 by the tongues 84 and 85. To this end, these tongues bear against inclined surfaces 86 and 87 of the part 81 through surfaces 88 and 89.

In normal operation the connector cannot move to the rear; it is locked in a retracted position by an abutment on the female connector which bears on one side 51 of the tongue 41. Pulling on the cable attached to the connector fastens together the male and female connectors.

As in the prior art connector the tongue 41 is fastened to the support by a flat base 50 wider than the tongue. The tongue 41 and the base 50 are inclined. The base 50 which joins the tongue 41 to the support 40 includes a transverse shoulder 51 for locking the male connector into the female connector at the end of insertion. The female connector is not shown in FIG. 3 but is diagrammatically represented in FIG. 2.

The cover 42 has a rear part through which the end of the cable 44 can be inserted after removing the jacket to expose the ends of the wires 43.

The front part of the cover 42 is joined to the part 91 with the housings 70 for the ends of the wires and joined to the rear part by an inclined bearing surface 52.

The rear part of the cover 42 comprises two side walls having racks 53 on the inside between which can be inserted a cable immobilizing member 54 with racks 55 on the outside matching the racks 53 on the inside of the cover 42. The immobilizing member 54 also comprises a tab 56 on each side adapted to move in a slot 57 in each rack of the cover 42. The cover 42 has slots 60 at the sides so that it can be fitted to the walls of the support 40. It also comprises vertical grooves 61 adapted to fit over respective vertical projections 62 on the sides of said support 40.

The male connector thus forms a deformable assembly which can be split in two: the part 80 which comprises the tongue 41 and the body 81. When the male connector is assembled, as shown in FIG. 4, the surfaces 88 and 89 of the connection head 80 are in contact with the surfaces 86 and 87 of the body 81. Pulling on the cable forces the male connector against the female connector through the intermediary of the surface 51, a traction force tending to move apart the parts 80 and 81. The bearing surfaces (86, 87, 88, 89) between these two parts are inclined to the direction of this force. This can be resolved into a component parallel to the traction force and a component perpendicular to the traction force. The perpendicular component tends to move the two tongues 84 and 85 towards each other and thus allows the part 80 to separate from the part 81 and therefore from the male connector as a whole.

To simplify the remainder of the description the term "support 40" is used to refer to the combination of the two parts 80 and 81 when fastened together.

Figure 5:
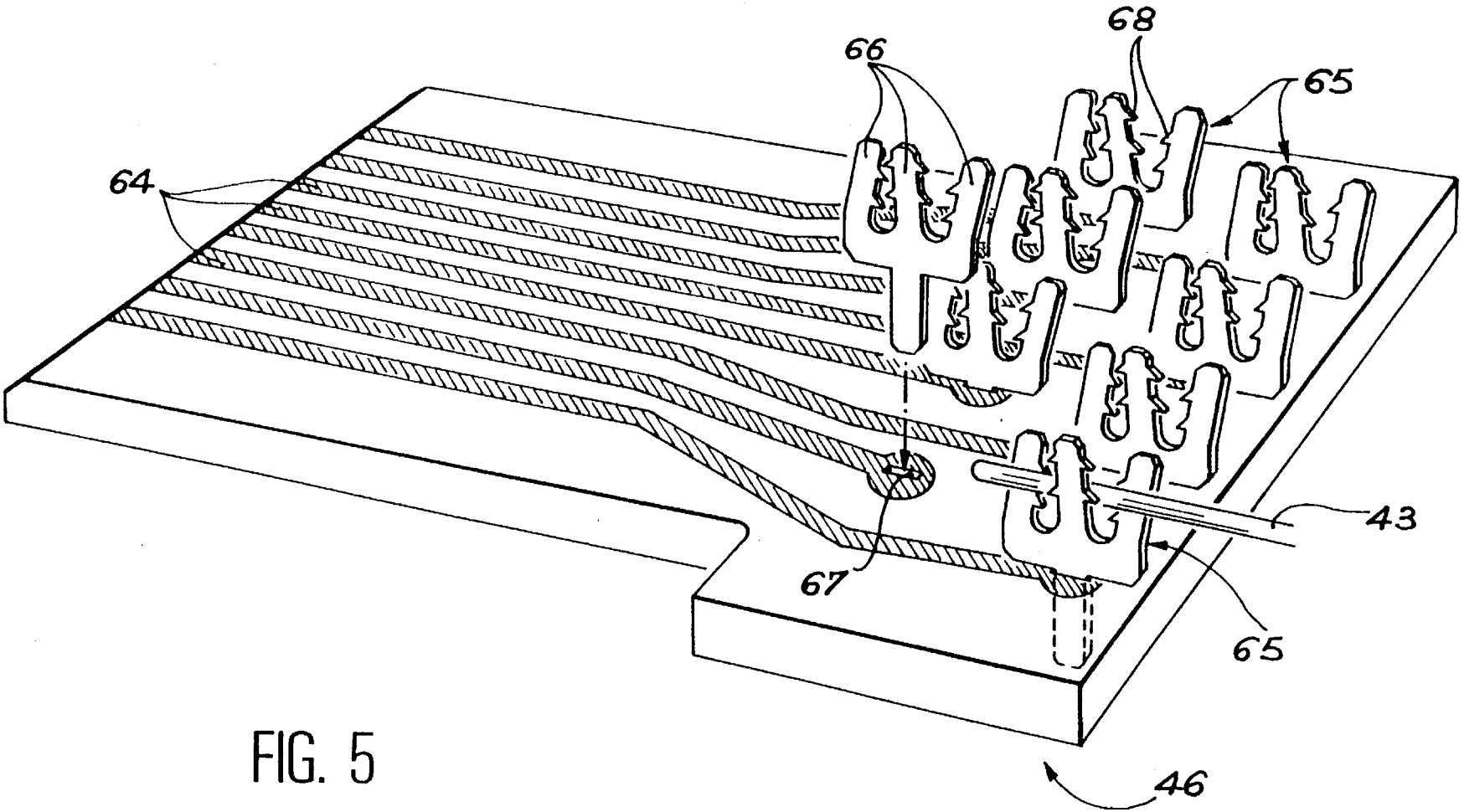
FIG. 5 shows the printed circuit provided with contacts designed to be inserted into the support of the male connector of the invention.

As shown in FIG. 5, the printed circuit 46 includes conductive tracks 64 with forked contacts 65 at the ends which can be inserted into through-plated holes 67. The contacts 65 have three branches 66, for example. They are disposed in a quincunx arrangement in two transverse rows. With the printed circuit 46 in place in the support 40 each contact is under the end of a wire 43 so that when the cover assembly 100 is pushed onto the support 40 each end of a wire 43 is gripped between the branches 66 of a contact 65.

Each contact 65 comprises at least two branches 66 each having on its inside surface(s) at least one sharp projection 68 adapted to tear the insulation of the wire 43 and so make contact with the core of the wire.

These contacts are therefore attached to the surface of the printed circuit 46 which includes printed tracks 64 which make contact with the respective terminals of the female connector. These contacts are made from a hard conductive material such as beryllium-bronze, for example.

The cable 44 can advantageously comprise a shield and a drain wire, which is an uninsulated wire running lengthwise of the shield; the cover 42, the part 81 of the support 40 and the immobilizing member 54 can then be metallized and electrically connected by contact to the shield and the drain wire to protect the data transmitted from electromagnetic interference and electrostatic discharge.

FIGS. 3 and 4 show the support 40 and the cover assembly 100 in two different and consecutive positions: a first position in which they are separated from each other and a second position in which they are fastened together.

An alternative breakdown of the parts of the assembly, based on two functions, is:

- firstly, the mechanical immobilization parts, namely the cable immobilizing member 54 and the cover 42 nesting in the support 81 to close the assembly. These parts can be of metallized plastics material for continuity with the shield of the cable and the nth pin, for example the 9th pin, of the female connector.
- secondly, the parts which locate external parts: the connecting member 91 locates the wires 43 of the cable 44 in the housings 70, the part 80 locates the contacts of the female connector in line with each track of the printed circuit. These parts can be of transparent insulative plastics material in order to show the various connecting members, such as the positions of the wires in the part 91, or the position of the printed circuit in the part 80, which cannot be conductive without shorting the tracks together, in which case there would be a common electrical point which is contrary to the requirement to obtain transmission on eight independent lines, for example.

The various stages of assembling the component parts of the male connector of the invention are now discussed.

1) Assembling the support casing 40:

The contacts 65, of which there are eight in this example, are soldered to the printed circuit 46, as shown in FIG. 5. This assembly is placed over the pegs 48 and 48' of the part 81 and engaged fully in the groove 78 in the part 79. The parts 80 and 81 are then assembled to form the support casing 40.

2) Preparing the cable 44:

The cable 44 is cut to length. A length of the jacket is stripped off. The shield and the drain wire are turned back on to the cable 44. The wires 43 of the cable 44 are positioned according to a color code relative to the installation or a specific function to be implemented.

3) Assembling the part 91 into the cover 42:

The part 91 is guided into the cover 42 by tabs at the side which move in grooves on the cover 42 (not shown in the figures). The two parts 91 and 42 are fastened together by virtue of deformation of a peg 92 which is triangular in shape, for example, on the top of the part 91, inside a cylindrical housing 93 in the cover 42. This assembly is a force fit. The corners of the triangle are an interference fit with the wall of the cylindrical housing, which deforms the triangle, fastening the two parts together with sufficient force.

4) Fitting the wires 43:

The wires prepositioned relative to each other are inserted into the housings of the part 91.

5) Immobilizing the cable 44:

The cable 44 is immobilized by the immobilizing member 54. The immobilizing system is a rack-type system. When the member 54 is fitted and the cable 44 clamped, the member 54 and the metallized part 42 are in electrical contact with each other and with the shield and the drain wire of the cable 44. This makes the electrical contact between the cable shield and the metallized parts like the parts 54 and 42.

6) Completing the assembly of the connector:

The support casing 40 and the cover assembly 100 joined to the cable are joined together to produce the final product. The two assemblies are guided relative to each other by the vertical projections 62 on the casing 40 and grooves 61 on the cover 42. Each wire 43 is in contact with one of the contacts 65. A small force is then needed to pierce the insulation and force the core of each wire between the branches 66 of a contact 65. When the two assemblies are in position a soft click is heard. This is caused by the four bosses 72 on the part 81 locating in four respective openings 71 in the sides of the cover 42. The metallized cover 42 is in contact with the metallized support 81 and electrical continuity is achieved between these two parts and therefore between the support 81 and the drain wire of the cable 44.

When the resulting male connector is inserted into a complementary female connector there is electrical continuity for each wire of the cable with the facing contact of the female connector via the printed circuit 46, providing electromagnetic shielding for the connection.

A connector of this kind has many advantages, including:

- the resulting male connector is split into two parts (the part 80 and the combination of the part 81, printed circuit 46 and cover assembly 100) if the cable 44 is pulled accidentally.
- the top of the printed circuit which carries tracks making the contact with the female connector enables neat and accurate location of the contact surface relative to a connection reference defined in the standard.
- the contacts are fixed into the support by a method with no prestressing, such as gluing, filling with resin or soldering; accordingly there is no stress on the connector and no deformation as seen end-on.
- this contact is electrically connected to the wires of the cable at the rear of the contact by movement of the wires over the contacts, and the connection force is no longer combined with the contact fixing force.
- the connection to the wires of the cable being offset a few millimeters rearwards from the front of the connector, it is possible to use wires with different overall diameters. The standard sets the width of the connector, but there is no restriction on the width at a certain level. The wire connection areas can therefore be moved apart. It is thus possible to use smaller gauge number wires. The wires can be solid-core or stranded.

In an alternative embodiment of the invention the contact can be provided by a connecting terminal of the type shown in FIG. 2; this terminal then has its rear end forked with a plurality of branches, so that the respective wire can be crimped in the manner shown in FIG. 5, for example.

We claim:

1. A disconnectable male connector for a communications network, the connector being designed to connect line wires of a multiline cable to lines of the network by plugging the male connector into a female connector having terminals connected to the lines of the network, the male connector comprising: a support housing forming a body that receives said cable and a terminal connection head on said body and pluggable into said female connector; connection means mounted in said support housing, the connection means being firstly connected to the line wires of the cable in said body and being secondly accessible on said connection head to enable them to be put into contact with said terminals when said head is plugged into the female connector; and means for locking to the female connector; the male connector being characterized in that said connection head (80) and said body (81) are in two mutually separable portions and are provided with securing means (84, 85, 86, 87) that come apart when traction is applied to said cable connected to said network.

2. A connector according to claim 1, characterized in that said connection head (80) includes at least one cavity (82), and in that said body (81) includes a peg (83) which enters said cavity (82) to position said connection head on said body.

3. A connector according to claim 1, characterized in that said securing means include on the connection head (80) two lateral tongues (84, 85) each having an inclined surface (88, 89) near an end thereof received on said body, and on the body (81) two inclined side walls (86, 87) on which the respective inclined surfaces of the two tongues bear when said connection head is on said body.

4. A connector according to claim 1, characterized in that said body is made of a metallized material.

5. A connector according to claim 1, characterized in that said connection head is made of plastics material.

6. A connector according to claim 1, characterized in that said connection means include first connection means (65) for connection to said wires (43) of the cable (44), and second connection means (46, 64) for sliding connection to the terminals of the female connector, said first and second connection means being interconnected inside said body (81).

7. A connector according to claim 6, further including immobilizing means (54) for immobilizing the cable (44) in an end of said support housing that is opposite from said connection head (81).

8. A connector according to claim 7, further including a cover assembly (100) containing said cable immobilizing means (54) and cover connection means (91) receiving the individual wires of said cable, the cover assembly being fitted to said body and locked thereon in order to close the body while connecting said cable wires to said first connection means.

9. A connector according to claim 8, characterized in that the first connection means include respective forked contacts (65) for each wire (43) of said cable, each contact being beneath an end of one of the wires (43) so that when the cover assembly (100) is forced onto the body (81), each wire end is crimped into a fork of a corresponding forked contact.

10. A connector according to claim 9, characterized in that each forked contact (65) comprises at least two branches (66) each having on an inside thereof at least one sharp projection (68) adapted to tear an insulation of the respective wire (43) to establish contact with a core thereof.

11. A connector according to claim 10, characterized in that each forked contact (65) can receive wires (43) of various gauges.

12. A connector according to claim 10, characterized in that each forked contact (65) is a first end of a connecting terminal which is partially embedded in said body, and which has another end that makes contact with the respective terminal of the female connector.

13. A connector according to claim 9, characterized in that said second connection means (46, 64) include a printed circuit (46) having printed tracks (64) making contact with the respective terminals of the female connector and to which said forked contacts (65) are connected.

14. A connector according to claim 13, characterized in that said connection head (80) includes a main cavity (45) receiving said printed circuit (46), inclined walls (47) on which said printed circuit received in said main cavity rests, and guide grooves (49) for opening said main cavity to an outside and for positioning the terminals of the female connector on the tracks of the printed circuit (46), and in that said body (81) includes support means (48) and abutment means (79) for said printed circuit (46).

15. A connector according to claim 8, characterized in that the cover connection means (91) have housings (70) into which the ends of the wires (43) of said cable are inserted.

16. A connector according to claim 15, characterized in that said cover assembly (100) includes a cover (42) having an open rear portion through which an end of the cable (44) can be inserted after a covering sheath thereof has been removed to release ends of the wires (43), and a front portion in which there are mounted said cover connection means (91) receiving the ends of said wires guided by an inclined bearing surface (52) between said front and rear portions, said rear portion receiving said immobilizing means for said cable.

17. A connector according to claim 14, characterized in that the cover (42), the body (81) and said immobilizing means (54) are metallized and electrically connected by direct contact to a shield and a drain wire of the cable (44) to protect transmitted data against electromagnetic interference and electrostatic discharge.

18. A connector according to claim 16, characterized in that the rear portion of the cover (42) is provided with two side walls provided with internal racks (53), and in that said means for immobilizing said cable are constituted by a cable-immobilizing member (54) received between the internal racks, and external racks (55) on the immobilizing member (54) designed to engage the internal racks (53) of the cover (42).

19. A connector according to claim 18, characterized in that said immobilizing member (54) also comprises a tab (56) on each side adapted to move in a groove (57) in each rack on an inside of the cover (42).

20. A connector according to claim 19, characterized in that the cover (42) includes side slots (60) enabling it to be fitted to the side walls of said body (81) and vertical grooves (61) received on corresponding projections (62) provided on the side walls of said body (81).

* * * * *